US010779627B1

(12) United States Patent
Bonge

(10) Patent No.: US 10,779,627 B1
(45) Date of Patent: Sep. 22, 2020

(54) ADJUSTABLE FACIAL SHAVING GUIDE

(71) Applicant: Scott Bonge, Little Rock, AR (US)

(72) Inventor: Scott Bonge, Little Rock, AR (US)

( * ) Notice: Subject to any disclaimer, the term of this patent is extended or adjusted under 35 U.S.C. 154(b) by 288 days.

(21) Appl. No.: 16/018,964

(22) Filed: Jun. 26, 2018

Related U.S. Application Data

(60) Provisional application No. 62/526,909, filed on Jun. 29, 2017.

(51) Int. Cl.
*A45D 27/42* (2006.01)
*A45D 24/36* (2006.01)

(52) U.S. Cl.
CPC ..... *A45D 27/42* (2013.01); *A45D 24/36* (2013.01)

(58) Field of Classification Search
CPC ..... A45D 27/42; A45D 27/36; A45D 27/00; A45D 44/12; A45D 40/30; A45D 2/50; B26B 21/42; B26B 21/4043; B26B 21/4081; B26B 21/40; A61C 19/04; A61C 19/045; A61C 19/05; A61C 19/38; A61C 19/42
USPC .... 132/214, 213, 213.1, 215, 289, 319, 333, 132/200; D28/44, 44.2, 44.1; 30/233.5, 30/34.05, 77
See application file for complete search history.

(56) References Cited

U.S. PATENT DOCUMENTS 1,013,077 A 12/1911 Sharro
1,247,787 A 11/1917 Bridges
1,329,437 A * 2/1920 Smith ..... B26B 21/42 132/214
1,526,028 A * 2/1925 Volkman ..... A45D 40/30 132/319
1,537,783 A * 5/1925 Olson ..... A45D 24/36 132/214
1,557,988 A * 10/1925 Devine ..... A61C 19/04 33/513
2,542,450 A * 2/1951 Altman ..... A45D 24/36 132/213
2,628,626 A * 2/1953 Teillaud ..... A45D 40/30 132/216

(Continued)

FOREIGN PATENT DOCUMENTS

DE 102007008622 A1 * 8/2008 ..... B26B 19/20
WO WO-2013096572 A1 * 6/2013 ..... B26B 19/388

(Continued)

*Primary Examiner* — Tatiana L Nobrega
*Assistant Examiner* — Samuel A Raque
(74) *Attorney, Agent, or Firm* — Quickpatents, LLC; Kevin Prince

(57) ABSTRACT

A guide device for trimming a person's beard includes a rigid body having a mouth anchor aperture through a proximal side and an open distal side covered by an attachable body cover that includes a threaded aperture therethrough for receiving a threaded tightening knob. A mouth piece anchor is adapted for fixing with a mouth piece rotation plate within the body. A mouth piece has a proximal end adapted for gripping with the person's mouth, and a distal end adapted for pivotally fixing with the mouth piece anchor. Left and right frames each have an inner side adapted for fixing with a frame clamp, and an outer side adapted for fixing with a shaving guide. In use, the knob is tightened to fix the mouthpiece and the frames in place. The person then holds the mouthpiece in his mouth to position the guide device on his face while shaving.

12 Claims, 6 Drawing Sheets

(56) References Cited

U.S. PATENT DOCUMENTS 2,804,684 A * 9/1957 Talamonti ..... A45D 2/50 30/34.05
2,917,055 A * 12/1959 Fouche ..... A45D 24/36 132/213
2,931,369 A * 4/1960 Badovinac ..... A45D 40/30 132/319
2,958,128 A * 11/1960 Narizzano ..... B26B 21/40 30/60.5
3,180,341 A 4/1965 Dumont
4,137,925 A * 2/1979 Castillo ..... A45D 24/36 132/214
4,616,998 A * 10/1986 Wong ..... A61C 19/045 33/514
5,875,790 A 3/1999 Morrison
6,526,660 B1 * 3/2003 MacNeil ..... B26B 21/222 30/50
6,618,948 B2 * 9/2003 Lin ..... B26B 19/20 30/233.5
6,655,389 B2 12/2003 Bertucci
7,559,331 B2 7/2009 Ward
7,628,161 B1 12/2009 LoSauro
8,015,981 B2 * 9/2011 Soare ..... A45D 44/00 101/127
8,082,927 B2 12/2011 Bonge
8,826,922 B1 9/2014 Lewis
8,997,612 B2 4/2015 Andrade
D785,247 S * 4/2017 DoSouto ..... D28/44.2
9,987,111 B1 * 6/2018 Alhuwaish ..... A61C 19/05
2003/0116172 A1 * 6/2003 Bertucci ..... A45D 27/42 132/214
2004/0074511 A1 * 4/2004 Sussan ..... A45D 24/36 132/214
2009/0173357 A1 * 7/2009 Bonge ..... A45D 27/42 132/214
2012/0233865 A1 * 9/2012 Kammer ..... B26B 19/3846 30/201
2013/0000657 A1 1/2013 Rofe
2013/0213429 A1 * 8/2013 Allen ..... A45D 24/36 132/214
2014/0318332 A1 * 10/2014 Eljaouhari ..... B26B 21/4081 83/13
2015/0020658 A1 * 1/2015 Eljaouhari ..... B26B 19/388 83/13
2015/0040934 A1 2/2015 Krenik
2015/0265026 A1 9/2015 Yeheskel
2016/0166040 A1 6/2016 Chandler
2016/0250762 A1 9/2016 Eljaouhari
2016/0255938 A1 9/2016 Brunett

FOREIGN PATENT DOCUMENTS

WO WO-2016196335 A1 * 12/2016 ..... A61C 19/045
WO WO-2019165455 A1 * 8/2019 ..... A61C 19/05

* cited by examiner

ADJUSTABLE FACIAL SHAVING GUIDE

CROSS-REFERENCE TO RELATED APPLICATIONS

This application claims the benefit of U.S. Provisional Patent Application 62/526,909, filed on Jun. 29, 2017, and incorporated herein by reference.

STATEMENT REGARDING FEDERALLY SPONSORED RESEARCH AND DEVELOPMENT

Not Applicable.

FIELD OF THE INVENTION

This invention relates to razors, and more particularly to a guide for shaping a man's goatee with a razor or electric shaver.

DISCUSSION OF RELATED ART

Numerous innovations for hair trimming devices have been provided in the prior art that will be described. Even though these innovations may be suitable for the specific individual purposes to which they address, they differ from the present invention in significant ways as will be discussed.

A first example, U.S. Pat. No. 3,858,589, issued on Jan. 7, 1975, to Geiger teaches a set of tonsorial implements for maintaining the sideburns and moustache in a neat and attractive shape; the implements consisting of separate tools each one of which is designed to be used as a template for placement either over a sideburn or a moustache so that a person can trim hair or whiskers projecting beyond the template edge; the templates each accordingly being specifically shaped and sized for a particular style of sideburn or moustache. One drawback with this type of hair trimming device is that it is not adjustable to a beard of a person, and it does not easily allow a person to easily hold the template in place without blocking the person's view in a mirror, for example.

A second example, U.S. Pat. No. 3,870,055, issued on Mar. 11, 1975, to Barbarow teaches a device for providing an outline pattern for styling a person's mustache that includes a template, a clamping arrangement receivable within the mouth of the person whose mustache is to be styled, and a member coupling the template with the clamping arrangement to locate and hold the template against the person's upper lip in response to reception of the clamping arrangement in the mouth and application of clamping pressure by the mouth upon the clamping arrangement. This type of hair trimming device is also not easily adjustable to the specific facial hair pattern of the user.

A third example, U.S. Pat. No. 6,655,389, issued on Dec. 2, 2003, to Bertucci, teaches a device for styling hair comprising a pair of side walls, a top support member connected to the side walls, and a bottom support member connected to the pair of side walls. The device also includes an intermediate support member connected to the pair of side walls between the top support member and the bottom support member to form an upper opening between the top support member and the intermediate support member and to form a lower opening between the bottom support member and the intermediate support member. A method for styling a goatee comprising the steps of providing a device having an upper opening and lower opening, positioning lips in the upper opening and a chin including a goatee in the lower opening, and trimming an area around the goatee as desired. This type of hair trimming device is also not adjustable to a beard of the user, and cannot be easily held by the user without blocking his view in a mirror, for example.

A fourth example, U.S. Document 20040074511, published on Apr. 22, 2004, to Sussan teaches a guide to trim and shave facial hair that is held in place by a chin plate and releasable neck strap holding the plate tight on the chin. The guide has a pair of clamps rotatably connected to the chin plate, each clamp having an aperture slidably receiving a calibrated guide rod, the clamp being capable of securing the rod at a variable distance from the chin plate. A second embodiment has an additional pair of guide rods slidably and rotatably attached to the first pair of guide rods by a second pair of clamps. The second pair of guide rods extend from the first pair of rods at a variable distance from the chin plate and can be rotated in parallel planes with the first pair of rods about the axis of the second clamp. This type of device is difficult to use and adjust to the user, and further is overly complicated and therefore expensive to manufacture.

In my previous U.S. Pat. No. 8,082,927, issued on Dec. 27, 2011, I teach a shaving guide held in place on a user's face by biting down on a mouth piece. However, this type of shaving guide is not adjustable in certain ways, like rotation or distance forward and backward, and as a result some have found such a device difficult to use comfortably.

It is apparent now that numerous innovations for hair trimming devices have been provided in the prior art that are adequate for various purposes. Furthermore, even though these innovations may be suitable for the specific individual purposes to which they address, accordingly, they would not be suitable for the purposes of the present invention as heretofore described.

None of the aforementioned prior art hair trimming devices teaches an adjustable facial shaving guide that is adjustable to a beard of a person, so that the beard of the person can be trimmed with a razor not shielded by the guide, while also being pivotable and adjustable forward and backward. Likewise, the shape of the guides is not easily adjusted in the aforementioned prior art devices. The present invention accomplishes this objective.

SUMMARY OF THE INVENTION

The present device is a guide device for trimming the beard of a person with a razor. A rigid body has a proximal side and a distal side. The proximal side has a mouth anchor aperture therethrough and the distal side is open. The body further includes two lateral sides, a top side, and a bottom side. Each lateral side includes a frame recess.

A rigid body cover is fixable with the body to cover the open distal side of the body. The body cover includes a threaded through-hole therethrough for receiving a threaded tightening knob therethrough.

A mouth piece anchor is adapted for fixing with a mouth piece rotation plate within the body with a mechanical fastener. A mouth piece has a proximal end adapted for gripping with a mouth of the person, and a distal end adapted for pivotally fixing with the mouth piece anchor.

A frame clamp has a proximal plate and a distal plate. Left and right frames each have an inner side adapted for fixing between the proximal plate and the distal plate of the frame clamp, and an outer side adapted for fixing with a guide.

Preferably the outer side of each frame includes a frame leg projecting away therefrom and adapted to engage a slidable receiver of each guide. As such each guide may be adjusted towards or away from the person's face.

As such, in use, with the frames projecting laterally through the frame recesses of the body, and the body cover fixed with the body, the threaded knob is tightened to squeeze the frame clamp and the mouth piece rotation plate against the distal side of the body to rotationally fix the mouthpiece and laterally fix the frames in place. The person may then insert the mouthpiece into his mouth to hold it in place on his face by imparting a biting pressure on the mouthpiece, the razor then being used with the guides to shape the person's beard. The person can adjust the distance that the rigid body sits away from his face, as well as the distance between the rigid body and each guide. The mouth piece can tilt up and down and rotate left and right with respect to the rigid body for comfort and a proper fit on the person's face.

The present device is an adjustable facial shaving guide that is adjustable to a beard of a person, so that the beard of the person can be trimmed with a razor not shielded by the guide, while also being pivotable and adjustable forward and backward. Different sets of lateral guides having different shapes can be utilized based on the person's style and tastes. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1:
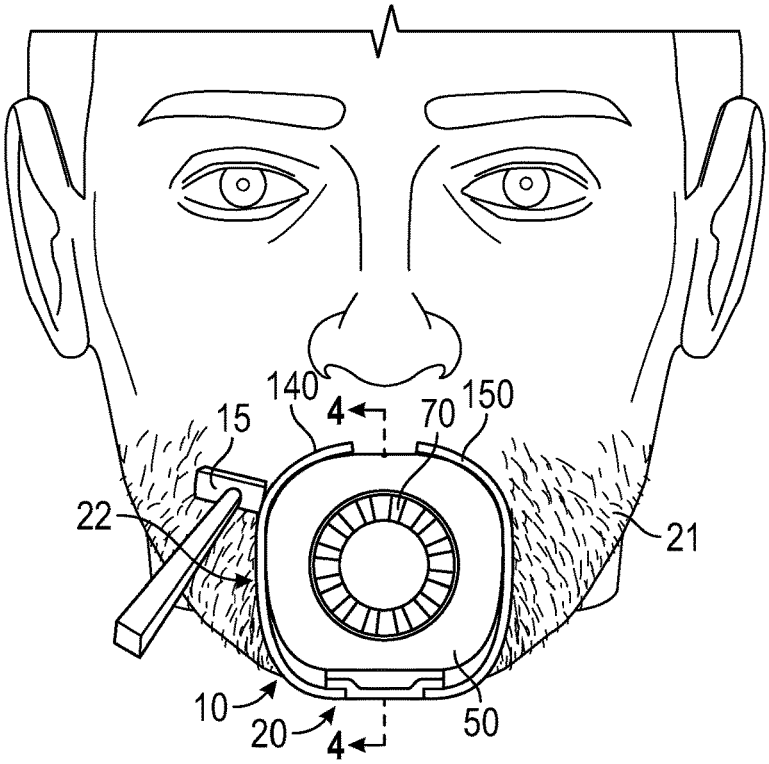
FIG. 1 is a front elevational view of the invention, shown as used by a person.
Figure 2:
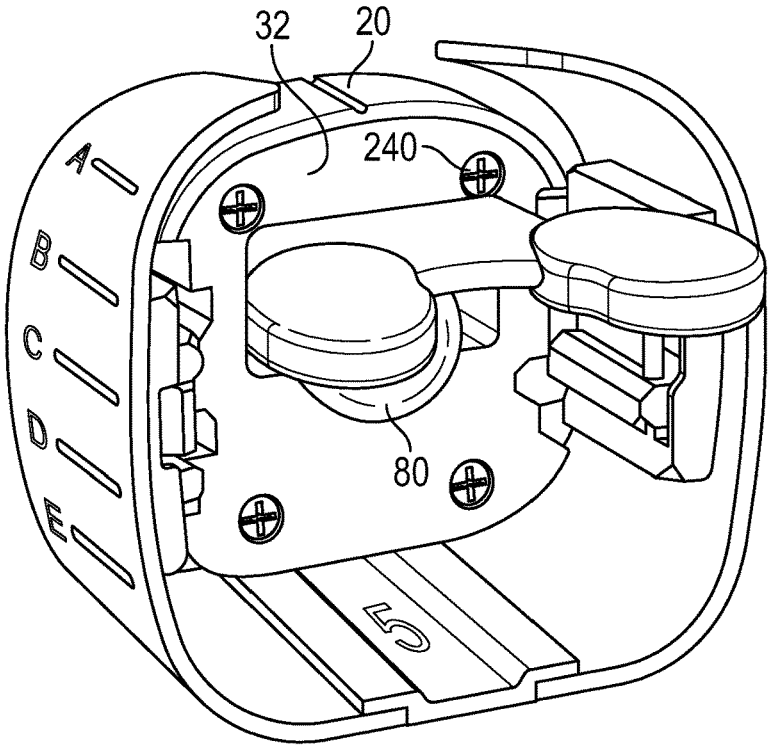
FIG. 2 is a rear perspective view of the invention.
Figure 3:
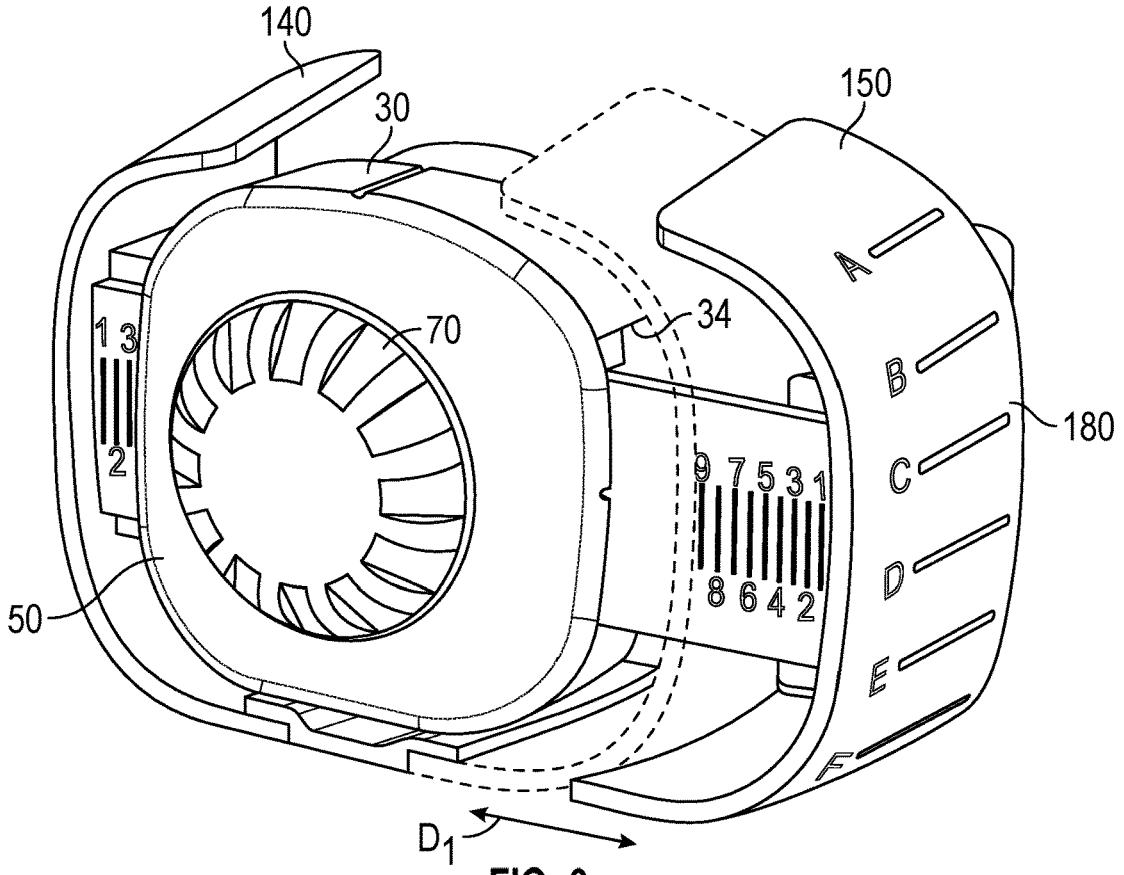
FIG. 3 is a front perspective view of the invention.
Figure 4:
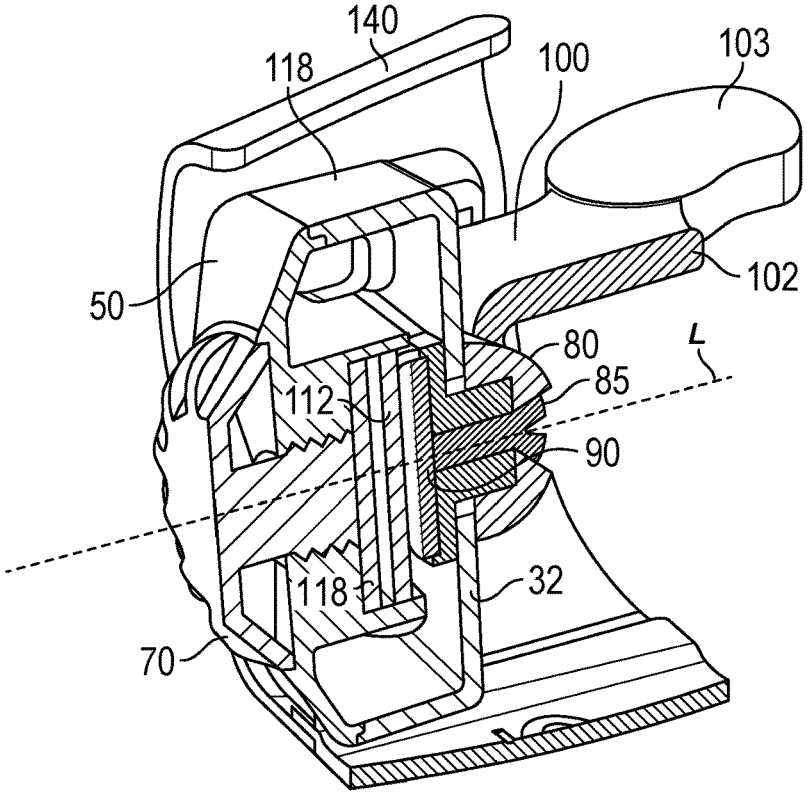
FIG. 4 is a cross-sectional view of the invention down a vertical center from front to back.

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

FIGS. 1-5 illustrate a guide device for trimming the beard 21 of a person 20 with a razor 15. A rigid body 30 has a proximal side 32 and a distal side 38. The proximal side 32 has a mouth anchor aperture 40 therethrough and the distal side 38 is open. The body 30 further includes two lateral sides 35, a top side 39, and a bottom side 31. Each lateral side 35 includes a frame recess 34. The rigid body 30 is preferably made with a rigid plastic material.

A rigid body cover 50 is fixable with the body 30 to cover the open distal side 38 of the body 30. The body cover 50 includes a threaded through-hole 60 therethrough for receiving a threaded tightening knob 70 therethrough. The proximal side 32 of the rigid body 30 preferably includes a plurality of screw apertures 220 (FIG. 5) cooperative with threaded apertures 230 of the body cover 50, such that threaded fasteners 240 traversing the screw apertures 220 of the rigid body 30 are tightened with the threaded apertures 230 of the body cover 50 to secure the body cover 50 to the rigid body 30. The body cover 50 is preferably made with a rigid plastic material, or the like.

A mouth piece anchor 80 is adapted for fixing with a mouth piece rotation plate 90 within the body 30 with a mechanical fastener 85. A mouth piece 100 has a proximal end 102 adapted for gripping with a mouth 22 of the person 20, and a distal end 108 adapted for pivotally fixing with the mouth piece anchor 80. Preferably the distal end 108 of the mouth piece 100 includes two cylindrical inwardly-directed and opposing prongs 109 adapted for rotationally fixing with lateral recesses 86 of the mouth piece anchor 80 (FIG. 5), such that the mouth piece 100 tilts upwardly and downwardly with respect to the rigid body 30. Additionally, the mouth anchor aperture 40 in the proximal side 32 of the rigid body 30 is preferably vertically oblong so that the mouth piece anchor 80 may move up and down within the mouth anchor aperture 40 for accommodating people having varying sizes of chins and for comfort of the person 20.

A frame clamp 110 has a proximal wall 112 and a distal wall 118. A left frame 120 has an inner side 122 adapted for fixing between the proximal wall 112 and the distal wall 118 of the frame clamp 110. An outer side 128 is adapted for fixing with a left guide 140. Similarly, a right frame 130 has an inner side 132 adapted for fixing between the proximal plate 112 and the distal plate 118 of the frame clamp 110. An outer side 138 is adapted for fixing with a right guide 150. Preferably the outer side 128,138 of each frame 120,130 includes a frame leg 125,135 projecting away therefrom and adapted to engage a slidable receiver 155 of each guide 140,150. As such each guide 140,150 may be adjusted towards or away from the person's face. The frame clamp 110, left and right frames 120,130, and guides 140,150 are all preferably made from a rigid plastic material.

In some embodiments the left and right frames 120,130 each include a distance indicia 160 for indicating to the person 20 a distance $D_1$ that the guides 140,150 are extended laterally away from the rigid body 30. Further, each frame leg 125,135 preferably includes a second distance indicia 170 for indicating to the person 20 a distance $D_2$ that the guides 140,150 are extended towards or away from the person's face. Further, each guide 140,150 includes a radial indicia 180 for indicating a radial position around the guide 140,150 with respect to the longitudinal axis L (FIG. 4) of the guide device 10.

Figure 6:
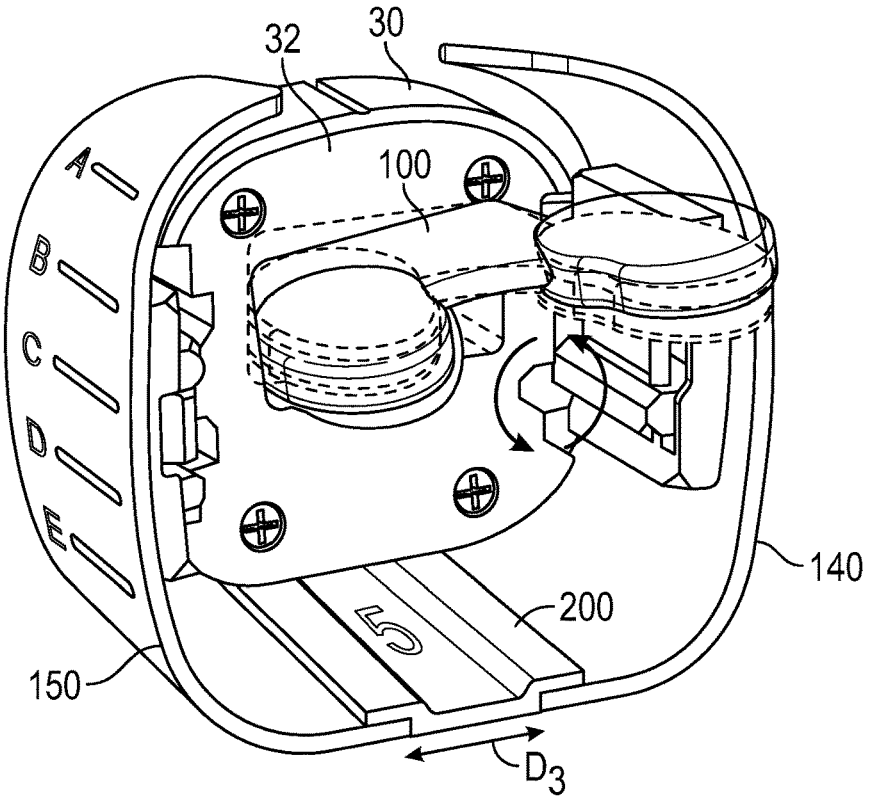
FIG. 6 is an alternate rear perspective view of the invention.
Figure 7:
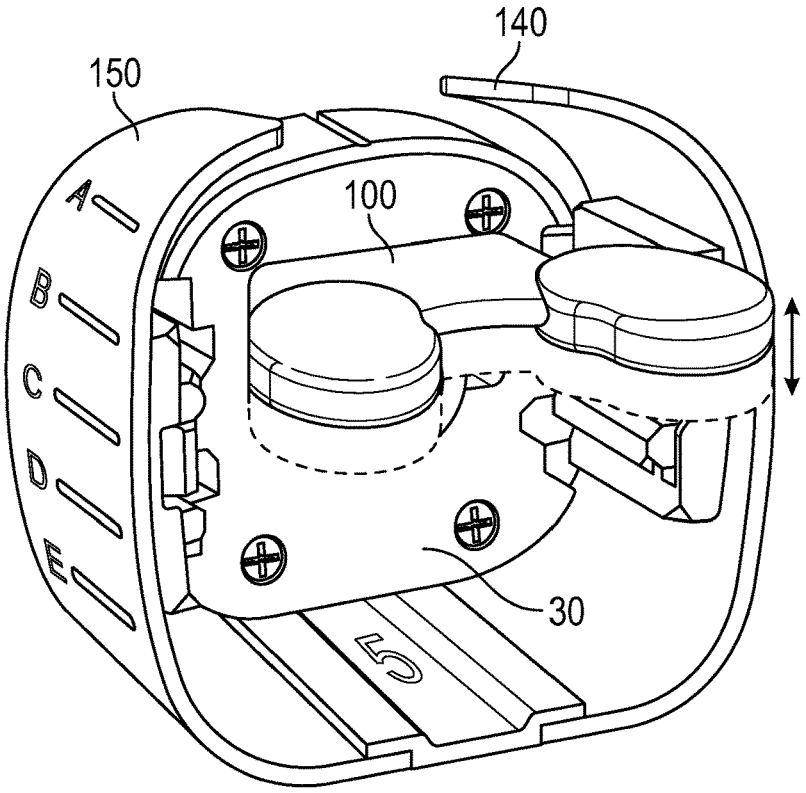
FIG. 7 is another alternate rear perspective view of the invention.
Figure 8:
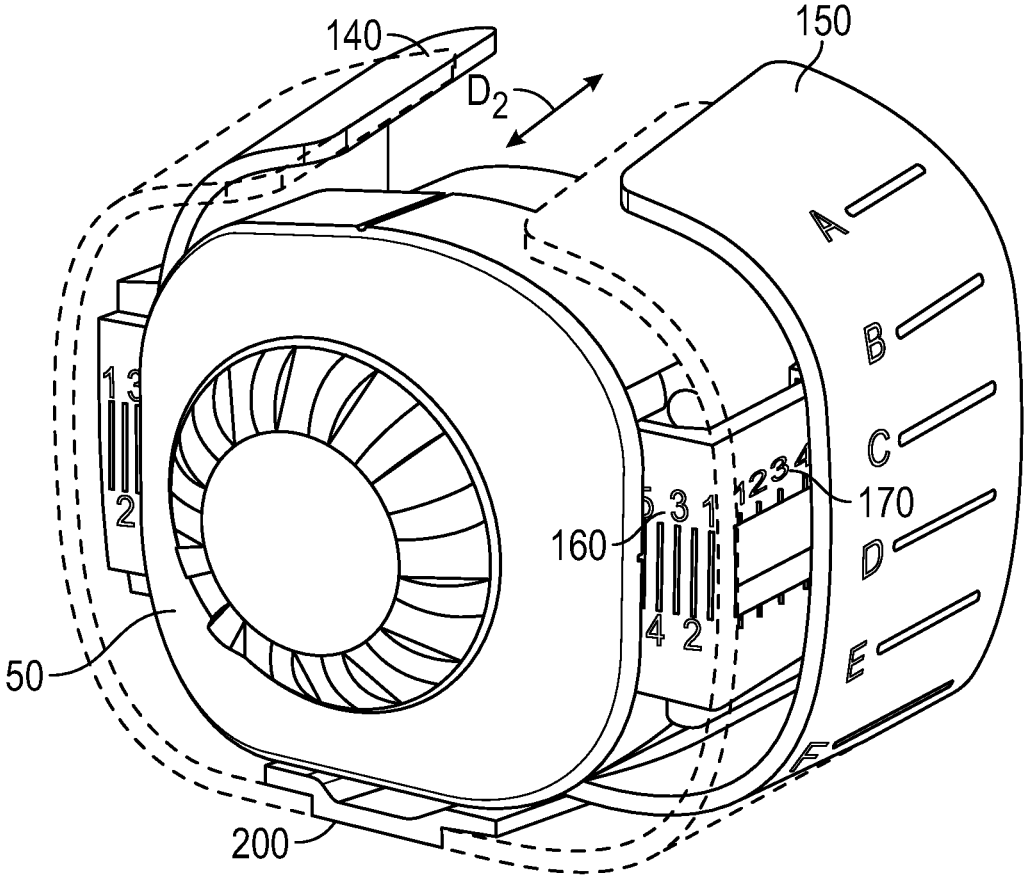
FIG. 8 is an alternate front perspective view of the invention.

As such, in use, with the left and right frames 120,130 projecting laterally through the frame recesses 34 of the body 30, and the body cover 50 fixed with the body 30, the threaded knob 70 is tightened to squeeze the frame clamp 110 and the mouth piece rotation plate 90 against the distal side 38 of the body 30 to rotationally and vertically fix the mouth anchor aperture 40, mouthpiece 100 and laterally fix the left and right frames 120,130 in place. The person 20 may then insert the mouthpiece 100 into his mouth 22 to hold it in place on his face by imparting a biting pressure on the mouthpiece 100, the razor 15 being used with the left and right guides 140,150 to shape the person's beard 21. The person 20 can adjust the distance $D_2$ that the rigid body 30 sits away from his face (FIG. 8), as well as the distance $D_1$ between the rigid body 30 and each guide 140,150. The radial indicia 180 can be used by the person to evaluate starting and stopping points with the razor 15 on the person's face for consistency from left to right, for example. The mouth piece 100 can tilt up and down (FIG. 7), rotate left and right (FIG. 6), with respect to the rigid body 30 for comfort and a proper fit on the person's face.

Figure 9:
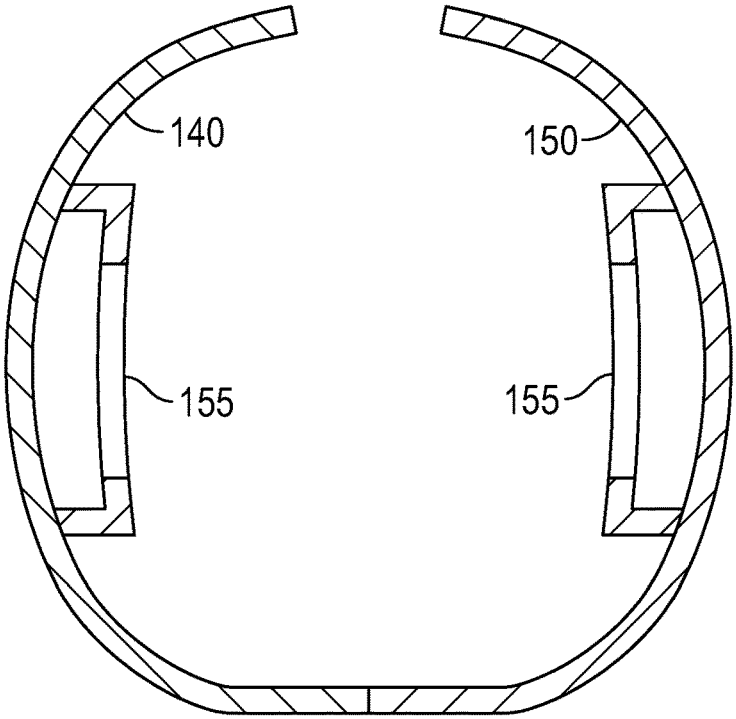
FIG. 9 is a cross-sectional front elevational view of one embodiment of a left frame and a right frame of the invention.
Figure 10:
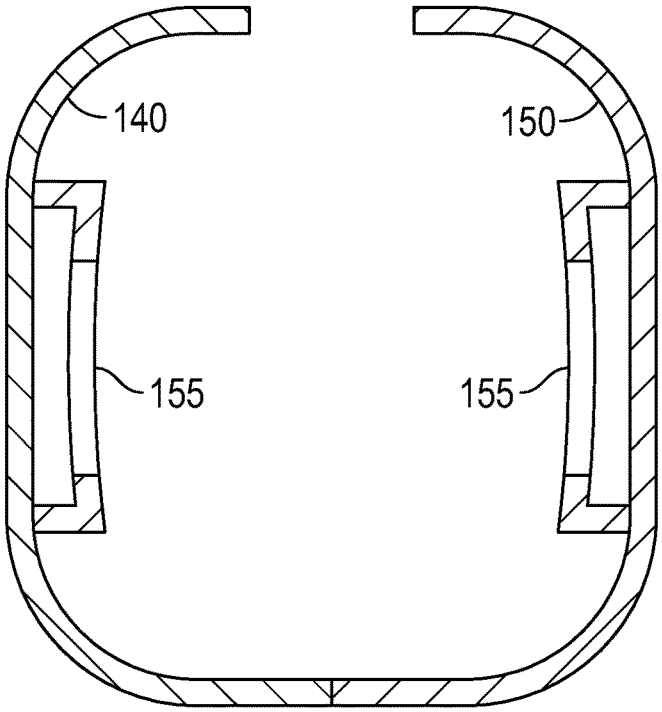
FIG. 10 is a cross-sectional front elevational view of another embodiment of the left frame and the right frame of the invention.

Preferably at least one additional pair of guides 140,150 are included that are each selectively attachable with the frame leg 125,130 of the corresponding left or fight frame 120,130 and that each have a unique shape (FIGS. 9 and 10).

Figure 5:
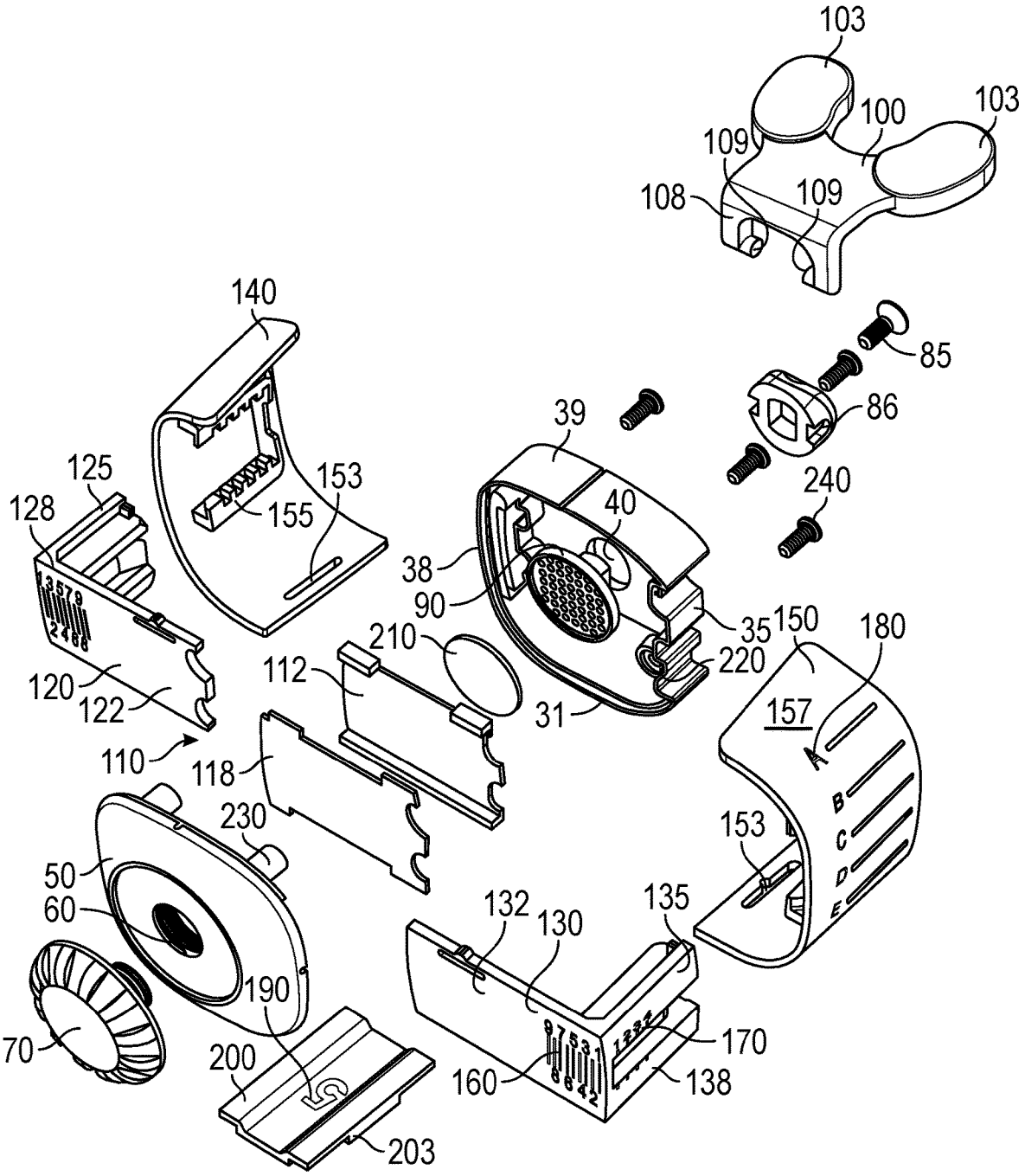
FIG. 5 is an exploded perspective view of the invention.

In preferred embodiments, the guide device 10 further includes at least one guide bottom 200 (FIG. 6) slidably retained with the bottom side 31 of the rigid body 30 and positionable generally between the left and right guides 140,150 when the left and right guides 140,150 are separated. Preferably each guide bottom 200 includes a number indicia 190 having a size corresponding to the distance indicia 160 and a separation distance $D_3$ between the left and right guides 140,150. A bottom side 152 of each guide 140,150 preferably includes at least one receiving slot 153 cooperative with a locking tab 203 included on each guide bottom 200 (FIG. 5). A similar but opposing guide top (not shown) may also be included for bridging a gap between the guides 140,150 at top sides thereof.

An elastomeric cushion 210 may be fixed between the mouth piece rotation plate 90 and the frame clamp 110, such that the person's mouth 22 is cushioned against impacts to the left or right guides 140,150. The mouth piece 100 may include a plurality of bite pads at the proximal end 102 thereof for facilitating gripping of the proximal end 102 by the person's mouth 22.

While a particular form of the invention has been illustrated and described, it will be apparent that various modifications can be made without departing from the spirit and scope of the invention. For example, the shape of the mouth piece 100, rigid body 30 and body cover 50, and guides 140,150 can all be altered somewhat from that shown in the figures without changing the manner in which these elements work together. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. An adjustable shaving guide device for trimming the beard of a person with a razor, comprising:

a rigid body having a proximal side and a distal side, the proximal side having a mouth anchor aperture therethrough and the distal side being open, the body further including a right side, a left side, a top side, and a bottom side, the right side and left side each including a frame recess;

a body cover disposed over the open distal side of the rigid body to cover the open distal side, the body cover including a threaded through-hole therethrough;

a threaded tightening knob engaging the threaded through-hole;

a mouth piece rotation plate disposed within the rigid body, where the mouth piece rotation plate projects through the mouth piece anchor aperture and is fixed to a mouth piece anchor with a mechanical fastener;

a mouth piece having a proximal end adapted for gripping with a mouth of the person, and a distal end pivotally coupled with the mouth piece anchor;

a frame clamp having a proximal plate and a distal plate;

a left frame having an inner side, the inner side of the left frame being disposed through the frame recess on the left side of the rigid body and being slideably disposed between the proximal plate and distal plate of the frame clamp, and an outer side of the left frame being fixed with a left guide such that the left guide extends adjacent to the left side of the rigid body;

a right frame having an inner side, the inner side of the right frame being disposed through the frame recess on the right side of the rigid body and being slideably disposed between the proximal plate and distal plate of the frame clamp, and an outer side of the right frame being fixed with a right guide such that the right guide extends adjacent to the right side of the rigid body;

whereby during use, the left and right frames projecting laterally through the frame recesses of the rigid body and a person slidably adjusts the position of the right and left guides by sliding the left and right frames and upon obtaining desired positions therefor, the threaded knob is tightened to: 1) squeeze the frame clamp and the mouth piece rotation plate against the proximal side of the rigid body, 2) rotationally and pivotally fix the mouthpiece and 3) laterally fix the left and right frames and the right and left guides at the desired positions, such that the proximal side of the mouth piece is positioned in the person's mouth with the guide device against the person's face and the right and left guides serve to guide the person to shave his face with a razor.

2. The adjustable shaving guide device of claim 1 wherein the distal end of the mouth piece includes two cylindrical inwardly-directed and opposing prongs rotationally coupled with lateral recesses of the mouth piece anchor, whereby the mouth piece tilts upwardly and downwardly with respect to the rigid body.

3. The adjustable shaving guide device of claim 1 wherein the left and right frames each include a distance indicia for indicating to the person a distance that the guides are extended laterally away from the rigid body.

4. The adjustable shaving guide device of claim 1 wherein the outer side of each frame includes a frame leg projecting away therefrom and slideably engages with a receiver of each guide, whereby each guide may be adjusted towards or away from the person's face.

5. The adjustable shaving guide device of claim 4 wherein the frame leg of each frame includes a second distance indicia for indicating to the person a distance that the guides are extended towards or away from the person's face.

6. The adjustable shaving guide device of claim 4 further including at least one additional pair of guides, each guide being selectively attachable with the frame leg of the corresponding left or right frame, each pair of guides having a unique shape.

7. The adjustable shaving guide device of claim 1 wherein an outer surface of each guide includes a radial indicia for indicating a radial position around the guide with respect to a longitudinal axis of the guide device which extends from the top side to the bottom side.

8. The adjustable shaving guide device of claim 1 further including at least one guide bottom slidably retained between the left and right guides when the left and right guides are not abutting and the at least one guide bottom is positioned adjacent to the bottom side of the rigid body.

9. The adjustable shaving guide device of claim 8 wherein the left and right frames each include a distance indicia for indicating to the person a distance that the guides are extended laterally away from each other, the at least one guide bottom comprising a plurality of guide bottoms where each of the plurality of guide bottoms include a number indicia having a size corresponding to the distance indicia and a separation distance between the left and right guides.

10. The adjustable shaving guide device of claim 8 wherein a bottom side of each guide includes a receiving slot, and each of the at least one bottom guide includes a locking tab, whereby each of the at least one bottom guide is selectively frictionally lockable with the left and right guide via engagement of the locking tab with the receiving slot.

11. The adjustable shaving guide device of claim 1 further including an elastomeric cushion fixed between the mouth piece rotation plate and the frame clamp, whereby the person's mouth is cushioned against impacts with the left or right guides.

12. The adjustable shaving guide device of claim 1 wherein the proximal side of the rigid body includes a plurality of screw apertures cooperative with a plurality of threaded apertures of the body cover, whereby threaded fasteners traversing the plurality of screw apertures of the rigid body are tightened within the plurality of threaded apertures of the body cover to secure the body cover to the rigid body.

* * * * *